United States Patent [19]

Badger

[11] 4,357,774

[45] Nov. 9, 1982

[54] FIREARM AND IMPROVEMENTS THEREIN

[76] Inventor: William A. Badger, 944 Military Dr., Salt Lake City, Utah 84108

[21] Appl. No.: 149,044

[22] Filed: May 12, 1980

[51] Int. Cl.[3] ..... F41C 1/00

[52] U.S. Cl. ..... 42/59

[58] Field of Search ..... 42/59

[56] References Cited

U.S. PATENT DOCUMENTS

| | | | |
|---|---|---|---|
| 99,893 | 2/1870 | Hill | 42/59 |
| 151,882 | 6/1874 | Jones | 42/59 |
| 191,178 | 5/1877 | Richardson | 42/59 |
| 358,915 | 3/1887 | Alston | 42/59 |
| 426,015 | 4/1890 | Herrick | 42/59 |
| 467,558 | 1/1892 | VonPecker | 42/59 |
| 627,966 | 7/1899 | Behr | 42/59 |
| 943,819 | 12/1909 | DuBose | 42/59 |
| 990,669 | 4/1911 | Rodehaver | 42/59 |
| 1,042,145 | 10/1912 | Rodehaver | 42/59 |
| 3,093,922 | 6/1963 | Ivy | 42/59 |
| 3,145,495 | 8/1964 | Katz et al. | 42/59 |
| 3,173,221 | 3/1965 | Ivy | 42/59 |
| 4,041,633 | 8/1977 | Scrufari | 42/59 |
| 4,197,666 | 4/1980 | Ng | 42/59 |

*Primary Examiner*—Charles T. Jordan
*Attorney, Agent, or Firm*—M. Ralph Shaffer

[57] ABSTRACT

A firearm, especially of a type accommodating multiple caliber cartridges. In a preferred form, a revolver incorporates an axially revolvable barrel having plural bores of different caliber. The barrel is preferably selectively detachable and reversible top for bottom. A separately mounted means is provided for shell ejection. The revolving cylinder employed is provided with cartridge receiving bores of different caliber and is reversible end for end, being provided at opposite axial extremities mutually displaced sets of teeth accommodating appropriate cylinder rotation, this depending upon the caliber then selected. Means are provided for regulating different cylinder placements for the individual cylinder bores as to each set and as to the respective bores of each set. A safety feature is included for insuring that firing can occur only when proper cylinder and barrel registration exists. An axial member accommodates cylinder rotation and placement, being suitable designed for the cylinder reversing feature.

10 Claims, 10 Drawing Figures

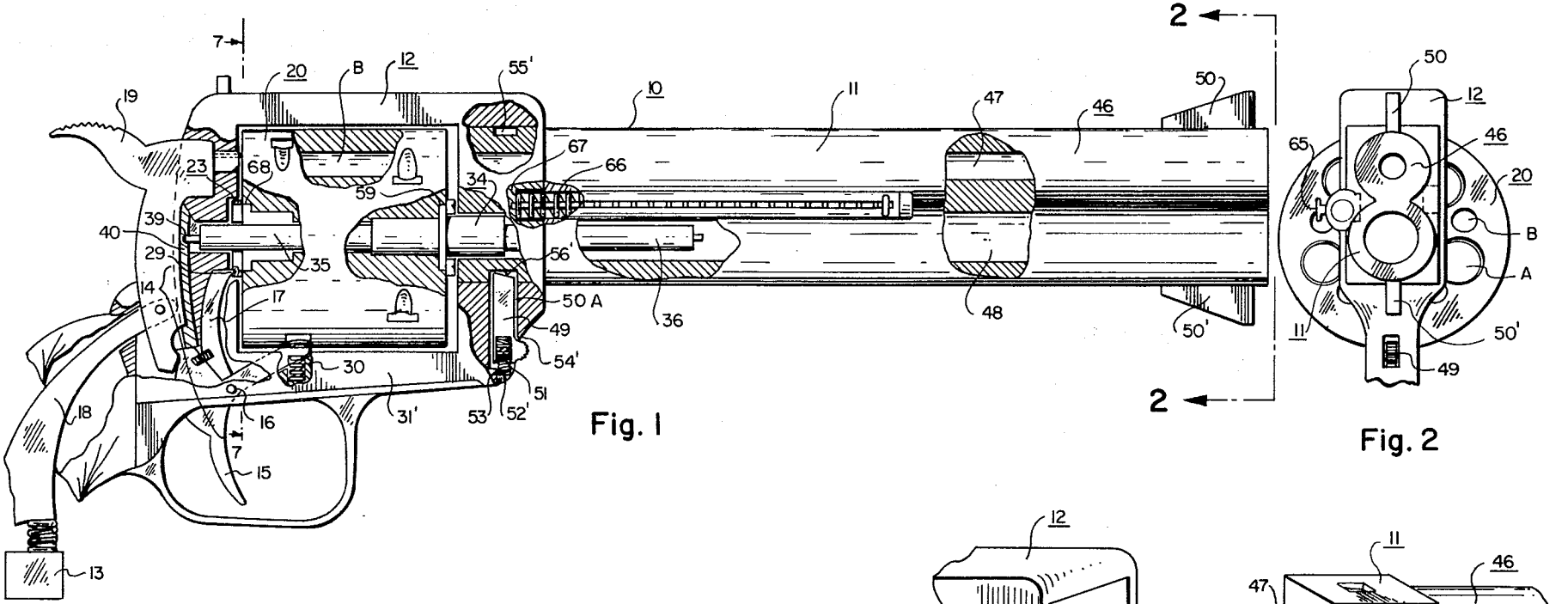
Fig. 1
Fig. 2
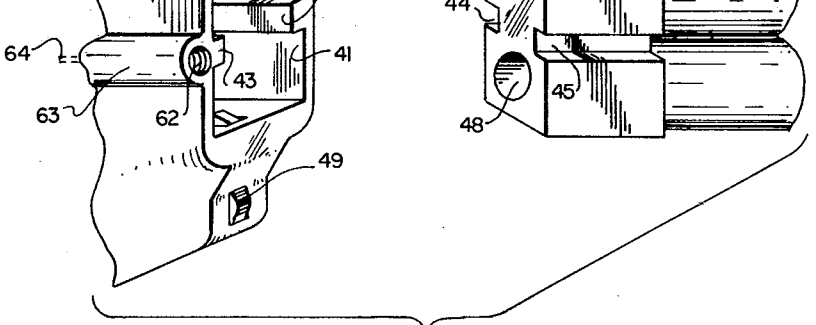
Fig. 4
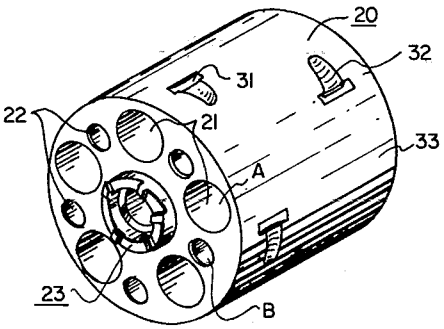
Fig. 3

FIREARM AND IMPROVEMENTS THEREIN

FIELD OF THE INVENTION

The present invention relates to firearms and, more particularly, to a new and improved revolver. In a preferred form of the invention the revolver has a barrel provided with plural bores of different caliber, and also appropriate cylinder and other structures which can be used to effect, in desirable manner, quick selection of cartridge caliber for an individual gun.

DESCRIPTION OF PRIOR ART

In the past a number of different types of revolvers have been devised. This likewise holds true in connection with revolvers accommodating multiple calibers. Relevant to this field of the revolver art are the following U.S. Patents:

U.S. Pat. No. 151,882 teaches the concept of a pivotally rotable barrel having a large bore and a small bore, separately revolving cylinders being employed.

U.S. Pat. No. 191,178 teaches the employment of a barrel with two bores, two independently operated hammers, and a cylinder of revolving character.

U.S. Pat. No. 426,015 shows a longarm having a reversible barrel.

U.S. Pat. No. 943,819 teaches a revolver with a single hammer which operates to fire one of the barrels, or both barrels simultaneously, of a plural barrel mechanism. The cylinder has an outer set and an inner set of cartridge chambers.

U.S. Pat. No. 990,669 teaches a longarm having interior and exterior sets of cartridge bores in its revolving cylinder. The barrel has plural bores, the barrel being nonrotative.

U.S. Pat. No. 1,042,145 likewise teaches a nonreversible cylinder having inner and outer rings of cartridge bores, the barrel or barrels being multi-caliber.

U.S. Pat. No. 3,093,922 is relevant in connection with a revolver cylinder incorporating plural sets of cartridge bores of differing caliber. Means are also provided for forwardly indexing the cylinder as the hammer is cocked, and the gun is provided with one or two separate barrels or a beveled bored barrel.

U.S. Pat. No. 3,145,495 teaches a revolver, but this time having an exchangable revolvable cylinder wherein one cylinder is replaced with another containing live cartridges.

U.S. Pat. No. 3,173,221 teaches a revolver cylinder having a pair of sets of cartridge bores of differing caliber. A single hammer and trigger mechanism serves for selective firing of the cartridges of either caliber and, with the other patents cited herein, is related in general to the invention herein disclosed.

U.S. Pat. No. 4,041,633 teaches a revolver having a pair of barrels and a rotating cylinder of cartridge bores of differing caliber. Here, however, plural strike pins are employed.

In none of the patents above cited is there taught a reversible single cylinder, to set detent positionment of the cylinder depending upon its end-for-end orientation, unique barrel detachment and reattachment means, shell ejection capability in the manner herein taught, or the various safety features in cylinder mountings as taught in this invention.

BRIEF SUMMARY OF THE PRESENT INVENTION

According to the present invention, a firearm such as a longarm or, preferably, a revolver or pistol, is provided with a pair of barrel-bores of differing caliber. Preferably a single barrel member having a pair of bores will be used, the barrel member being separately detachable and reattachable, and also reversible by virtue of capability for 180° revolvement about its longitudinal axis. Means are provided for receiving and releasably locking the barrel member into the frame or block. A separate, cartridge ejection means is employed which is free of attachment to the barrel member per se. A single trigger mechanism and firing pin combination is employed. The cylinder is designed for reversal, end for end, this so that bores of differing caliber, having a common locus as their respective centers, may be employed. Appropriate means is provided to mount the cylinder at its central longitudinal axis. Means is also incorporated to prevent the firing of cartridges through a differently sized barrel-bore. Means are also provided to detent the cylinder appropriately, whether it is in its forward or reversed position.

OBJECTS

Accordingly, a principal object is to provide a new and improved firearm.

A further object is to provide a gun block or frame that can accommodate substitute barrel members and cylinders of differing sets and/or combinations of bore sizes.

A further object is to provide a firearm accommodating differently sized cartridges, this without replacing the usual cylinder employed.

A further object is to provide a firearm having a barrel member or barrel piece which is detachable and reattachable and which incorporates plural bores of different sizes.

A further object is to provide a firearm in which the cylinder is reversible, this to accommodate the appropriate firing of different sized cartridges.

A further object is to provide a pistol wherein the cylinder employed has different-sized cartridge bores, the centers of which describe a common circular locus.

An additional object is to provide means in a multiple-bore firearm wherein inadvertent misalignment of cylinder bores with barrel bore size is obviated.

A further object is to provide a separate cartridge release mechanism for a firearm which is separate from the detachable barrel thereof.

A further object is to provide appropriate means for releasably mounting a cylinder in a firearm, this where the cylinder is of a reversible type.

IN THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a side elevation, partially broken away and sectioned, of a pistol firearm constructed in accordance with a preferred embodiment of the invention.

FIG. 2 is an end elevation taken along the line 2—2 in FIG. 1.

FIG. 3 is a perspective view of the cylinder of the firearm of FIG. 1.

FIG. 4 is a fragmentary, perspective, exploded view of the firearm block and barrel member of the structure of FIG. 1.

FIG. 8 is an end view of the reverse or opposite end of the cylinder, with the toothed means of the structure being displaced relative to that shown in FIG. 7.

DESCRIPTION OF PREFERRED EMBODIMENTS

Figures 5, 6, 7, 8, 9, 10:
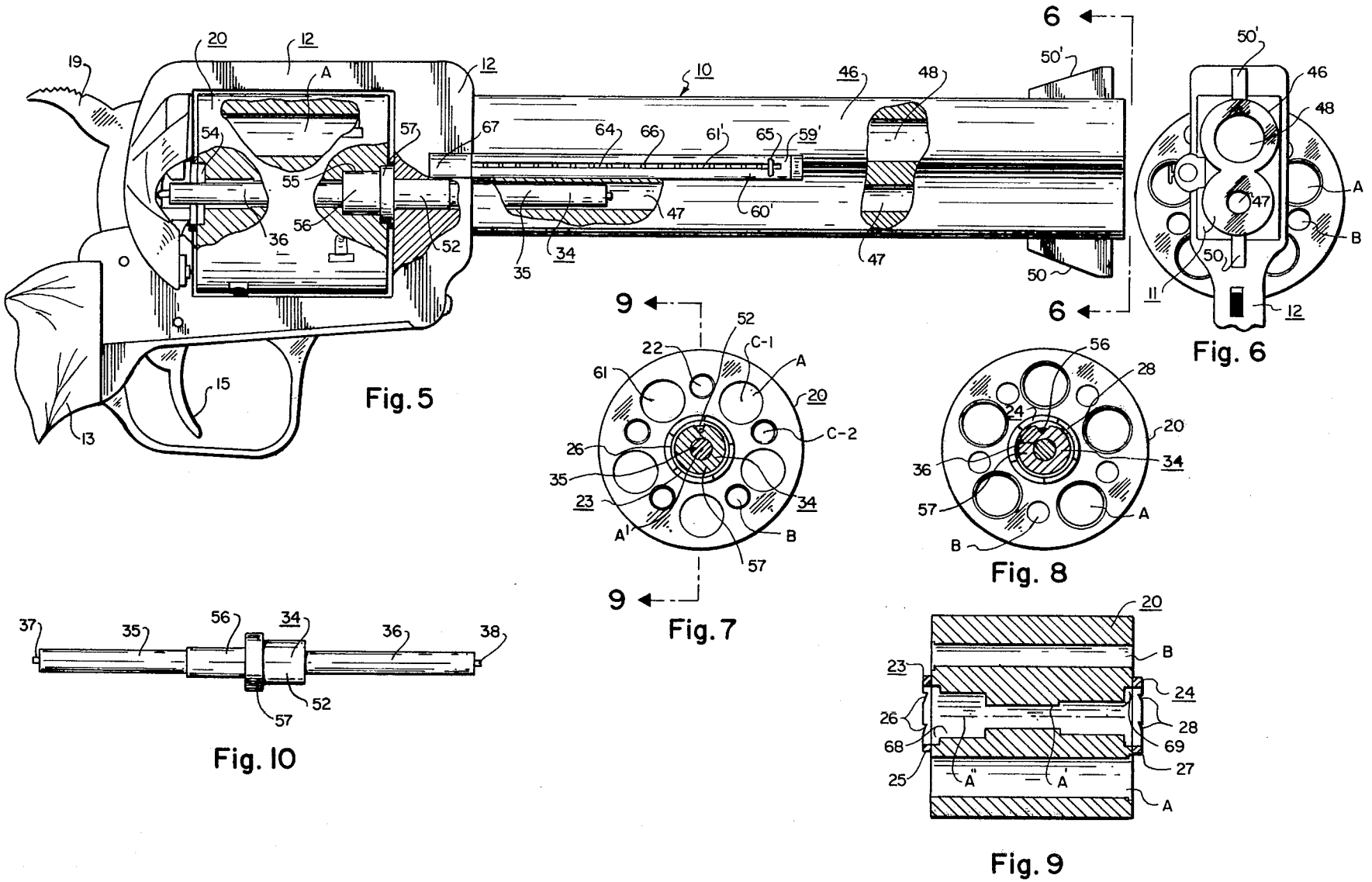
FIG. 5 is similar to FIG. 1, but illustrates the condition of the piston wherein the cylinder has been reversed and the barrel member thereof rotated 180°.
FIG. 6 is an end elevation taken along the line 6—6 in FIG. 5.
FIG. 7 is an end view of the revolving cylinder of the firearm shown in FIGS. 1 and 5, being taken along line 7—7 in FIG. 1.
FIG. 8 is similar to FIG. 7 that illustrates the orientation of the cylinder shown in FIG. 5.
FIG. 9 is a transverse vertical section taken along the line 9—9 in FIG. 7.
FIG. 10 is a side elevation of the member used to releasably mount the cylinder to the firearm in FIG. 1.

In the drawings firearm 10 takes the form of a pistol having barrel member 11, block or frame 12, handle 13, and trigger and firing mechanism 14, the latter being conventional in form and forming no part of the present invention per se. As to the trigger and firing mechanism, the same will include the usual trigger 15 which is pivoted to block 12 by pivot 16 and which co-acts with pawl 17 and lever 18 in securing the retrieval and subsequent firing of hammer 19. Hammer 19 will be spring-biased in the usual manner (this is not shown) and pawl 17 serves to advance cylinder 20 in the usual manner by engagement with annular toothed means 23. Cylinder 20 is best described at the outset and is shown to include plural sets 21 and 22 of large caliber bores A and small caliber bores B. See also FIG. 9. Toothed means 23 (FIG. 3) is preferably integral with the cylinder and comprises ring 25 having a series of notches 26. Correspondingly, toothed means 24 comprises a ring 27 having a series of notches 28. The toothed means 23, 24, are alternately engaged by the cylinder rotational advancement pawl 17 at tooth 29, see FIG. 1. A spring loaded detent 30 is provided the lower portion 31' of block 12 and engages detent notches 31, and, when the cylinder is reversed, notches 32 on the periphery 33 of cylinder 20. It is to be noted that the centers C-1 and C-2 of the large and small bores of the cylinder describe, as to their locus, a circle concentric about axis A" of the cylinder and particularly, aperture A' concentric about such axis. Member 34 in FIGS. 1, 5 and 10 includes a pair of opposite extending shafts 35 and 36 each having centering buttons 37 and 38 that alternately seat into recess 39 of block 12 or its attachment, as the case may be. See attachment member 40.

Block 12 includes a receptacle 41 including guide rails 42 and 43. These are received by slots 44 and 45, see FIG. 4, as the barrel member 46 provided with small bore 47 and large caliber bore 48, fits into the receptacle 41. This may be simply a slide type engagement. Preferably, a detent lock 49 will be provided in slot 50A in block 12, see FIG. 1, which is spring-biased by compression spring 51 against threaded cap 52' that threads into aperture 53. Slot 54' accommodates the up-and-down movement of the detent, and barrel member 46 includes notches 55' and 56' which alternately receive the detent lock at 49. Barrel member 46 is provided with sights 50 and 50'. It is noted, relative to FIGS. 1, 4, 5 and 6 that the barrel member is easily disassociated from the block 12, rotated 180° about its longitudinal axis, and then re-installed by virtue of detent lock 49.

Member 34 is a cylinder mounting member for cylinder 20. When disposed in the position shown in FIG. 1, i.e., with boss 52 disposed within large bore 48, then the cylinder is prepared for operation in one mode wherein small cartridges disposed within the small bores B will be fired. When the barrel member 46 is withdrawn as shown in FIG. 4, so that the member 34 can also be withdrawn out of receptacle 41, then the cylinder is easily reversed end-for-end and the member 34 re-installed, this time in a reverse condition, see FIG. 5, so that that recess 55, opposite to recess 54 of the cylinder, will now be engaged by the remaining boss 56. Accordingly, boss 52 now is snugly seated within barrel bore 47 and bore 48 is aligned with large caliber bore A of the cylinder. Ring 57 abuts barrel member 11.

In both instances, the outwardly radially extending ring 57 between the two bosses or boss portions 52 and 56 serves to provide a shoulder for co-action with one of the two seats 68, 69 of the cylinder.

In operation, the firearm, this time preferably taking the form of a pistol, incorporates the usual trigger and firing mechanism which is conventional in the art. However, most important is the inclusion of the reversible barrel which is selectively withdrawn from, rotated 180°, and then re-installed in the provided receptacle 41 of the firearm block 12. But one cylinder is needed, and no replacement therefor, since the cylinder includes bores of differing calibers whose centers form a circular locus concentric about the center of the cylinder. The cylinder is reversible end for end and is provided with the mounting means taking the form of mounting member 34 so that there is no possible chance of misalignment of a small bore of a cylinder with a large bore of the barrel member. This is assured since the large boss of the cylinder mounting member 34 is actually inserted into the large bore of the barrel member, thus aligning the small bores B of the barrel with the small bore of the barrel member. The detent notch series 31 and also series 32 are mutually displaced, and off-center relative to the cylinder, so that these will be useful in properly positioning the cylinder bores, large or small as the case may be, appropriately for firing. Further, the teeth of the notches of toothed means 23 and 24 will be offset relative to fore and aft positions of the cylinder, so that the notches can cooperate with tooth 29 of pawl 17 in bringing the cylinder up to appropriate firing position relative to the bore, large or small, to be utilized for a particular barrel setting. Accordingly, what is provided is a new and useful firearm incorporating an end-for-end reversible cylinder that can be useful in receiving simultaneously cartridges of differing caliber. A single trigger mechanism or firing pin can be used since, preferably, the centers of all of the bores in the cylinder, whatever their size, are uniformly concentrically positioned relative to the revolvment axis of the cylinder.

Also, and to facilitate cylinder mounting, the barrel member 10 is completely removable from the firearm block 12, this not only to effect reversal of the barrel bores, but also removal of the cylinder mounting member. Proper registration of barrel bores with cylinder bores is assured by virtue of the structure herein employed.

It is important to note that the same principles may be used either singly or in combination in connection with long arms such as rifles, shotguns and the like.

Accordingly, what is presented is a new and useful firearm which can accommodate multiple caliber cartridges and thus, a single firearm can be used and very conveniently manipulated in the field so that different caliber cartridges can be fired as desired by the user.

Where desired, a cartridge shell ejector may be used as is seen at 59' in FIG. 5. This may comprise a tube 60' having slot 61' that is threaded into threaded aperture 62 of boss 63. An elongate pin 64 has a finger actuator 65 and is spring-biased by compression spring 66 acting against seat 67. According, the user may urge the pin rearwardly to eject shells as desired.

It is seen that recesses 68 and 69, see FIG. 9, of the cylinder merely serve to store along axis A'' that particular boss 52, 56, (with a portion of adjacent ring 34A) of its cylinder mounting member piece, which is not then inserted into a respective barrel member bore. Aperture A' selectively receives shafts 35, 36.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. In a firearm provided with a revolvable cylinder, a cylinder-mounting block and a plural-bore releasably detachable barrel member of longitudinally elongated dimension: an improvement wherein said cylinder includes cartridge bores of plural sizes and is end-for-end reversible, and said block is provided with means for longitudinally releasably receiving said barrel member in both, alternately, of two positions axially rotationally 180° apart, and means for releasably locking said barrel member to said block in a selected position.

2. The structure of claim 1 wherein said barrel member and block have interengaging guides and guideways parallel to said longitudinally elongated dimension.

3. The structure of claim 1 wherein said means comprises a pair of oppositely disposed surface notches provided said barrel member and a single spring-biased slideable detent means provided said block and selectively engaging a selected one of said notches.

4. In a firearm provided with a cylinder mounting block and a plural-bore barrel member: an improvement wherein said block is provided with means for releasably receiving said barrel member in both, alternately, of two positions axially rotationally 180° apart, and means for releasably locking said barrel member to said block in a selected position, and wherein said block is provided with spring-biased cartridge ejector means disposed parallel to but separate from said barrel member.

5. A firearm revolvable cylinder having a central axis of revolvement and provided with cartridge bores of differing caliber-size but having centers the combination of which describes a single circular locus concentric with said axis whereby all of said bores may be accommodated by a single firing pin.

6. The structure of claim 5 wherein said revolvable cylinder has at its opposite ends respective toothed means for aiding in effecting cylinder rotational displacement, each of said respective toothed means being off-set and disposed in opposite advancement directions relative to each other, smaller sized ones of said cartridge bores being interspersed between larger sized ones of said cartridge bores, all of said bores being cylindrical.

7. A firearm revolvable cylinder having a central axis of revolvement and provided with cartridge bores of differing caliber-size but having centers the combination of which describes a circular locus concentric with said axis, and wherein said cylinder is end-for-end reversible and is provided with plural sets of mutually-spaced, oppositely facing, peripheral, cylinder-positioning detent notches, said sets being mutually off-set to accommodate particular bore positionment.

8. A firearm provided with a cylinder mounting block; a barrel member extending from said block and having plural bores of differing sizes; a trigger mechanism and firing means mounted to said block; and end-for-end reversible cylinder releasably mounted in said block and having plural sets of bores of differing caliber, said cylinder also having a central axis aperture; an elongate, end-for-end reversible cylinder mounting piece provided with a medial ring, bosses on opposite sides of and of lesser respective cross-sections than said ring which fit respective ones of said barrel member bores, and also having oppositely extending cylinder-journaling shafts of similar diameter relative to said cylinder aperture and extending oppositely from a respective one of said bosses, said cylinder having respective enlarged recesses at its opposite ends concentric with said cylinder aperture and dimentioned to receive, and a respective one receiving, a respective one of said bosses, said ring abutting said barrel member about a respective one of said barrel member bores.

9. A firearm including, in combination: a frame provided with a trigger and firing mechanism; an end-for-end reversible cartridge cylinder disposed in said frame and having cartridge bores of differing sizes; an axially rotatable, plural bore barrel member attached to said frame; and end-for-end reversible cylinder mounting means disposed in said frame, revolvably mounting said cylinder, and fitted into the then non-firing bore of said barrel member.

10. The structure of claim 9 wherein said cylinder mounting means comprising an elongate member having a central ring; a pair of bosses contiguous with said ring, of reduced size relative to said ring, and dimensioned to fit a respective bore of said barrel; and opposite extending shaft extension means extending from respective ones of said bosses for selectively journalling said cylinder.

* * * * *